US012714910B2

(12) United States Patent
Thorup et al.

(10) Patent No.: US 12,714,910 B2
(45) Date of Patent: Aug. 25, 2026

(54) DEVICES, SYSTEMS, AND METHODS FOR MEASURING SPIN OF A GOLF BALL

(71) Applicant: GOLFTEC ENTERPRISES LLC, Englewood, CO (US)

(72) Inventors: Don Thorup, Englewood, CO (US); Rahim Stennett, Englewood, CO (US); Phil Schaefer, Englewood, CO (US)

(73) Assignee: GOLFTEC ENTERPRISES LLC, Englewood, CO (US)

( * ) Notice: Subject to any disclaimer, the term of this patent is extended or adjusted under 35 U.S.C. 154(b) by 277 days.

(21) Appl. No.: 18/396,920

(22) Filed: Dec. 27, 2023

(65) Prior Publication Data

US 2025/0213920 A1 Jul. 3, 2025

(51) Int. Cl.

| | |
|---|---|
| ***G06K 9/00*** | (2022.01) |
| ***A63B 24/00*** | (2006.01) |
| ***A63B 69/36*** | (2006.01) |
| *A63B 71/06* | (2006.01) |

(52) U.S. Cl.

CPC ..... *A63B 24/0006* (2013.01); *A63B 69/3658* (2013.01); *A63B 2071/0694* (2013.01); *A63B 2220/05* (2013.01); *A63B 2220/16* (2013.01); *A63B 2220/35* (2013.01)

(58) Field of Classification Search

CPC ..... G06T 7/246; G06T 7/254; G06T 2207/30241; A63B 24/0006; A63B 69/3658; A63B 2071/0694; A63B 2220/05; A63B 2220/16; A63B 2220/35

See application file for complete search history.

(56) References Cited

U.S. PATENT DOCUMENTS

| | | | | |
|---|---|---|---|---|
| 2010/0210377 A1* | 8/2010 | Lock | ..... | A63B 69/3658 473/409 |
| 2022/0047923 A1* | 2/2022 | Durham | ..... | A63B 37/0027 |

* cited by examiner

*Primary Examiner* — Duy M Dang
(74) *Attorney, Agent, or Firm* — Haynes and Boone, LLP

(57) ABSTRACT

A method for measuring spin of a golf ball includes obtaining at least two images of the golf ball after a golf club contacts the golf ball. The method also includes identifying the time span between the obtained at least two images to create a numerical time difference, defining an outline of the golf ball while the golf ball is in flight, finding at least one marking on the golf ball in each golf ball image, finding the rotations of the golf ball by aligning the at least one marking on the golf ball in each golf ball image, and converting the rotations of the golf ball into spin values by combining the rotations and the numerical time differences, wherein the spin values comprise at least a spin axis and a rotation angle. The spin values may then be displayed to a user.

14 Claims, 12 Drawing Sheets

DEVICES, SYSTEMS, AND METHODS FOR MEASURING SPIN OF A GOLF BALL

TECHNICAL FIELD

The subject matter described herein relates to devices, systems, and methods for measuring the spin of a golf ball. This ball spin measurement system has particular but not exclusive utility for predicting the trajectory of a golf ball and/or providing guidance on a golfer's swing.

BACKGROUND

Systems exist to predict the motion of a golf ball that has been struck by a golf club. However, because of aerodynamic effects, the motion of a golf ball is highly dependent on the spin of the ball, which may be unknown or poorly known. Thus, it is to be appreciated that such commonly used motion prediction systems have numerous drawbacks, including but not limited to, poor prediction of sliced or hooked shots, and otherwise. Accordingly, long-felt needs exist for improved predictions that address the forgoing and other concerns.

The information included in this Background section of the specification, including any references cited herein and any description or discussion thereof, is included for technical reference purposes only and is not to be regarded as subject matter by which the scope of the disclosure is to be bound.

SUMMARY

Disclosed is a ball spin measurement system which computes the spin (e.g., backspin and side spin) of a golf ball in flight. The ball spin measurement system disclosed herein has particular, but not exclusive, utility for predicting the trajectory of a golf ball and/or providing guidance on a golfer's swing. The ball spin measurement system includes a strobe light system, a camera, a system of light-shaping lenses, and a processor that functions by obtaining multiple images of the ball in motion (e.g., in flight), identifying the outline of the ball in each image, finding marks in each ball image, finding the orientations of the ball that best align the marks in the ball images, and converting the rotation of the ball into spin values.

A system of one or more computers can be configured to perform particular operations or actions by virtue of having software, firmware, hardware, or a combination of them installed on the system that in operation causes the system to perform the actions. One or more computer programs can be configured to perform particular operations or actions by virtue of including instructions that, when executed by data processing apparatus, cause the apparatus to perform the actions. One general aspect includes a method of measuring spin of a golf ball. The method includes obtaining at least two images of the golf ball after a golf club contacts the golf ball; identifying a time span between the obtained at least two images to create a numerical time difference; defining an outline of the golf ball while the golf ball is in flight; and finding at least one marking on the golf ball in each golf ball image. The method also includes finding rotations of the golf ball by aligning the at least one marking on the golf ball in each golf ball image; and converting the rotations of the golf ball into spin values by combining the rotations and the numerical time differences, where the spin values may include at least a spin axis and a rotation angle. The method may also include displaying the spin values to a user. Other embodiments of this aspect include corresponding computer systems, apparatus, and computer programs recorded on one or more computer storage devices, each configured to perform the actions of the methods.

Implementations may include one or more of the following features. In some embodiments, the spin axes and the angles are converted into an equivalent pair of rotations about a horizontal Z axis and vertical Y axis, where the horizontal Z axis rotation corresponds to backspin and the vertical Y axis rotation corresponds to sidespin. In some embodiments, the spin axes and the angles are converted into an equivalent pair of rotations about a horizontal X axis and vertical Y axis, where the horizontal X axis rotation corresponds to the backspin axis and the Y axis corresponds to the sidespin axis. In some embodiments, the at least two images of the golf ball are taken by a single camera in quick succession and stored in quick succession. In some embodiments, the camera further may include a long shutter that stays open for an extended period of time. In some embodiments, the camera further may include at least two strobe flashes, where the at least two strobe flashes create a double exposure effect with the at least two images of the golf ball superimposed in one overall image taken by the camera. In some embodiments, the camera is housed in a launch-monitor positioned approximate to a golfer hitting golf balls. In some embodiments, the launch monitor displays the spin values to be viewed by the golfer. In some embodiments, the at least two images of the golf ball are taken by two cameras in quick succession and stored in quick succession. In some embodiments, the X, Y, and Z coordinates are determined in an orthonormal projection. In some embodiments, the X, Y and Z coordinates of the at least one mark on the golf ball are determined from a known 2D location of the at least one mark within a circle defining the golf ball in the golf ball images. Implementations of the described techniques may include hardware, a method or process, or computer software on a computer-accessible medium.

One general aspect includes a system which includes a memory, a display, and one or more processors operatively coupled to the memory, the processors being configured to execute operations that, when executed, cause the processors to perform operations. The operations may include: obtaining at least two images of a golf ball after a golf club contacts the golf ball captured by a camera positioned approximate to a golfer; identifying a time span between the obtained at least two images to create a numerical time difference; defining an outline of the golf ball while the golf ball is in flight; finding at least one marking on the golf ball in each golf ball image; finding rotations of the golf ball by aligning the at least one marking on the golf ball in each golf ball image; and converting the rotations of the golf ball into spin values by combining the rotations and the numerical time differences, where the spin values may include at least a spin axis and a rotation angle. Other embodiments of this aspect include corresponding computer systems, apparatus, and computer programs recorded on one or more computer storage devices, each configured to perform the actions of the methods.

Implementations may include one or more of the following features. In some embodiments, the spin axes and the angles are converted into an equivalent pair of rotations about the horizontal Z axis and vertical Y axis, where the horizontal Z axis rotation corresponds to backspin and the vertical Y axis rotation corresponds to sidespin. In some embodiments, the at least two images of the golf ball are taken by the camera in quick succession and stored in quick succession. In some embodiments, the camera further may include a long shutter that stays open for an extended period of time. In some embodiments, the camera further may include at least two strobe flashes, where the at least two strobe flashes create a double exposure effect with the at least two images of the golf ball superimposed in one overall image taken by the camera. In some embodiments, the camera, memory and one or more processors are housed in a launch-monitor positioned approximate to a golfer hitting golf balls. In some embodiments, the display shows the spin values to be viewed by the golfer. In some embodiments, the spin axes and the angles are converted into an equivalent pair of rotations about a horizontal Z axis and vertical Y axis, where the horizontal Z axis rotation corresponds to backspin and the vertical Y axis rotation corresponds to sidespin. In some embodiments, the system may include a second camera that obtains additional images of the golf ball taken in quick succession and stored in quick succession. Implementations of the described techniques may include hardware, a method or process, or computer software on a computer-accessible medium.

One general aspect includes a non-transitory computer-readable storage medium having encoded therein programming code executable by a processor to perform operations. The operations include obtaining at least two images of a golf ball after a golf club contacts the golf ball; identifying a time span between the obtained at least two images to create a numerical time difference; defining an outline of the golf ball while the golf ball is in flight, finding at least one marking on the golf ball in each golf ball image; finding rotations of the golf ball by aligning the at least one marking on the golf ball in each golf ball image; and converting the rotations of the golf ball into spin values by combining the rotations and the numerical time differences, where the spin values may include at least a spin axis and a rotation angle. Other embodiments of this aspect include corresponding computer systems, apparatus, and computer programs recorded on one or more computer storage devices, each configured to perform the actions of the methods.

This Summary is provided to introduce a selection of concepts in a simplified form that are further described below in the Detailed Description. This Summary is not intended to identify key features or essential features of the claimed subject matter, nor is it intended to limit the scope of the claimed subject matter. A more extensive presentation of features, details, utilities, and advantages of the ball spin measurement system, as defined in the claims, is provided in the following written description of various embodiments of the disclosure and illustrated in the accompanying drawings.

BRIEF DESCRIPTION OF THE DRAWINGS

Illustrative embodiments of the present disclosure will be described with reference to the accompanying drawings, of which.

DETAILED DESCRIPTION

Figure 1:
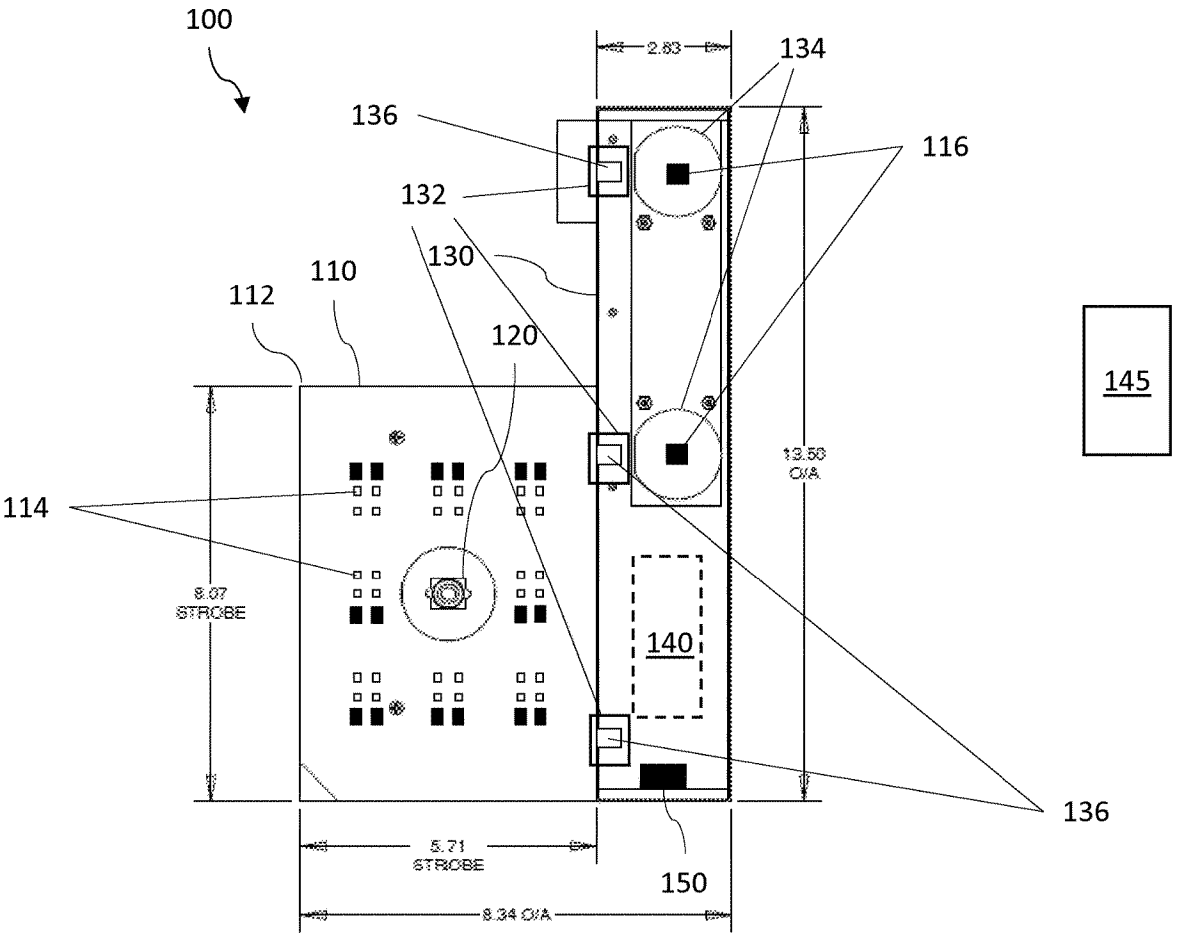
FIG. 1 is diagrammatic front view of at least a portion of an example ball spin measurement system, in accordance with at least one embodiment of the present disclosure.

In accordance with at least one embodiment of the present disclosure, a ball spin measurement system is provided which computes the spin (e.g., backspin and side spin) of a golf ball in flight.

Most views of a golf ball contain at least one marking, either an intentional marking from the manufacturer, or a mark caused by use, such as a scuff mark. In this disclosure, the term "spot" may be used as a synonym to "mark." In some embodiments, the user may apply additional marks to the ball to increase the visibility of marks and/or to enhance the accuracy of the spin calculations disclosed herein.

The ball spin measurement system functions by obtaining multiple images of the ball in motion (e.g., in flight), identifying the outline of the ball in each image, finding marks (if any) in each ball image, finding the orientations of the ball that best align the marks in the ball images, and converting the rotation of the ball into spin values.

Obtaining multiple images of the ball in motion (e.g., in flight) can be accomplished for example by, over a period of time, taking multiple separate photographs of the area in which the ball is flying. This may, for example, be done with two cameras that each take one photograph, with the second photograph being timed shortly after the first photograph. In some embodiments, if a single camera can capture and store images quickly enough, two images may be captured with the same camera in quick succession (e.g., over a period of less than 10 milliseconds and preferably less than 3 milliseconds). For example, for a golf ball moving at 80 meters per second, two images captured one millisecond apart will be separated by a distance of 8 centimeters. In a preferred embodiment of the present invention, one camera has its shutter open for an extended period of time (e.g., up to around 10 milliseconds for a 20 mph ball), then two strobe flashes are created, resulting in a double exposure with two images of the ball superimposed in one overall image taken by the camera. Depending on the implementation, the same principle can be applied to generate a triple-exposure, quadruple-exposure, etc.

Identifying the outline of the ball in each image may for example be accomplished with a circle-finding algorithm that analyzes the captured or stored image(s). It will be apparent to a person of ordinary skill in the art that such techniques can be applied to any of the alternatives described above (e.g., multiple separate images, two separate images, a single double-exposed or multiple-exposed image, etc.), with equivalent effect. Although the present disclosure frequently describes identifying multiple ball images from one photograph or scene image, according to the preferred embodiment described above, it is understood that other images or sets of images may be used instead or in addition, without departing from the spirit of the present disclosure.

If the ball is brightly illuminated, one embodiment of the present invention uses one or more circle finding algorithms known in the art to locate the circle representing each ball image within the overall image. For example, the algorithm may scan the entire overall image with circle regions of varying size until it finds the best matches where the pixels within the circular region are significantly brighter than the pixels just outside the circular region. Other circle-finding algorithms, as described for example in image processing literature, may be used instead or in addition.

In a preferred embodiment of the ball spin measurement system, there are two images of the scene-one with the ball in flight, and one taken before or after the ball is in flight. The two images are subtracted, which operation accentuates the balls since the regions where the ball is located will have a relatively large difference between the two scene images. The difference image is then treated as the overall image for finding the circles representing the balls.

Finding marks in each ball image may involve looking for anomalous pixels within the circle representing each ball image. In the case of a golf ball, this may for example involve finding regions of the ball image that are darker than the surrounding images. In one non-limiting example, the ViVo Mouse wireless head-tracking mouse software uses specialized algorithms for finding features to track between images. Other techniques known in the art may be used instead or in addition.

For example, one embodiment of the present disclosure uses edge-finding algorithms known in the art of image processing, such as Sobel operators, which identify pixel regions where a change in brightness is seen over a region of pixels. In this exemplary embodiment, the edges thus found are considered to be the marks. This may result in some marks that appear, to a human, to be a single mark instead being detected as multiple edge areas. However, in most cases this does not impede the proper operation of the ball spin measurement system as described herein. For example, an elongated mark may be detected as a series of several smaller marks, since the regions of relative darkness may be found over several pixels. If there are multiple mark representations corresponding to what a human would consider one mark, these marks can still be aligned according to the algorithms described herein. In the examples that follow, when reference is made to a mark, in practice, the algorithm may include multiple closely-located marks, within the scope of the algorithm as described.

Alternately, marks may be described in terms of their shape and size, so that a large mark can be treated as fewer marks than would be found by the simpler edge detection algorithm described above. Although the process of identifying a larger mark may be more complicated (for example, by using one or more clustering algorithms known in the art), the result may be rotation calculations may occur more quickly because there will be fewer combinations of marks to consider.

As noted above, the present disclosure involves capturing multiple images of a golf ball in flight, then calculating the spin based on the relative positions of one or more marks on the ball. This may for example involve finding the rotation of the ball that best aligns the marks in the ball images. In a non-limiting example, a first step in finding the rotation of the ball is to convert the marks in each two-dimensional (2D) ball image into a three-dimensional (3D) representation. Since the outline of the circle may be known, it may be assumed that the radius of a 3D representation of the ball has approximately the same radius as the circular outline of the ball in the image. Then, assuming an approximate sphere, geometrical relationships are used to calculate the 3D position of each mark that project to the known 2D location of the mark within the circle on the ball image.

Once the 3D positions of all marks are found, the next step is to find the rotation in 3D that causes the marks extracted from one ball image to line up with the marks extracted from the other ball image(s). In an example, the system may use a generate-and-test technique to find the best such alignment of the spots. The result is a set of rotation angles about one or more axes that describe the rotational motion of the ball between the multiple ball images. This step involves converting that rotation description into a description of the ball rotation in terms of golf-relevant parameters such as back spin and side spin, or other equivalent representations. Various algorithms exist in the art for converting such rotations, such as Euler Angle Rotations, into a spin axis. One preferred embodiment utilizes one of these algorithms to obtain a 3D rotation axis, along with an angle of rotation about that axis (e.g., an amount of rotation between the first image and the second image).

This information can then be used to predict the trajectory of the golf ball and/or to provide feedback to the user about possible improvements to their golf swing or club selection to reduce unwanted ball spin.

The present disclosure aids substantially in ball trajectory prediction and golf swing coaching, by improving the ability to quickly and accurately measure the spin (e.g., top spin, back spin, side spin, etc.) imparted on the ball by the user's swing and club choice. Implemented on a processor in communication with cameras and strobe lights (as well as other possible sensors including but not limited to a motion detector, proximity detector, depth sensor, depth sensor, etc.), the ball spin measurement system disclosed herein provides practical spin measurement capabilities in a field or office setting. This augmented sensing and computation transforms a coarse trajectory calculation into one that accurately predicts the aerodynamic motion of the ball, without the normally routine need to deduce the user's ball spin tendencies based on a sampling of actual trajectories. This unconventional approach improves the functioning of the computer system used to predict ball trajectories, by providing additional critical inputs to the trajectory prediction algorithms.

Depending on the implementation, the ball spin measurement system may be implemented as a process at least partially viewable on a display or in physical printouts, and operated by a control process executing on a processor that accepts user inputs from a keyboard, mouse, touchscreen, or other user interface, and that is in communication with one or more sensors. In that regard, the control process performs certain specific operations in response to different inputs or selections made at different times. Outputs of the ball spin measurement system may be printed, shown on a display, reported as audio tones, or otherwise communicated to human operators. Certain structures, functions, and operations of the processor, display, sensors, and user input systems are known in the art, while others are recited herein to enable novel features or aspects of the present disclosure with particularity.

For the purposes of promoting an understanding of the principles of the present disclosure, reference will now be made to the embodiments illustrated in the drawings, and specific language will be used to describe the same. It is nevertheless understood that no limitation to the scope of the disclosure is intended. Any alterations and further modifications to the described devices, systems, and methods, and any further application of the principles of the present disclosure are fully contemplated and included within the present disclosure as would normally occur to one skilled in the art to which the disclosure relates. In particular, it is fully contemplated that the features, components, and/or steps described with respect to one embodiment may be combined with the features, components, and/or steps described with respect to other embodiments of the present disclosure. For the sake of brevity, however, the numerous iterations of these combinations will not be described separately.

These descriptions are provided for exemplary purposes only and should not be considered to limit the scope of the ball spin measurement system. Certain features may be added, removed, or modified without departing from the spirit of the claimed subject matter.

FIG. 1 is diagrammatic front view of at least a portion of an example ball spin measurement system 100, in accordance with at least one embodiment of the present disclosure. In the example shown in FIG. 1, the ball spin measurement system 100 includes a strobe light assembly 110, a camera module 120, a light curtain assembly 130, and a processor 140.

The strobe light assembly 110 may for example include a printed circuit board (PCB) 112, that includes a plurality of infrared (IR) light-emitting diodes (LEDs) 112. The strobe light assembly is used to create the strobes (flashes) of light to illuminate the ball for the double-exposure images as described above.

The camera module 120 may for example be a circuit board to which an imaging chip and lens assembly are mounted, along with interface and power supply modules to run and control the camera chip, although other configurations may be used instead or in addition. In an example, the camera module may output images in a 2D image format such as MIPI-2, although other formats may be used instead or in addition.

The light curtain assembly 130 contains IR LEDs and IR photodetectors arranged in a geometry so that the received IR signals reflected from the ball are indicative of the ball's position and speed. Light curtain assembly 130 can include a plurality of light curtain lenses 132, for example containing an optical film lens for bending or shaping the light emitted by the light-curtain LEDs 136 to create a "curtain" of light through which the ball will fly when hit. In some embodiments, there are additional LEDs, in addition to the strobe LEDs 114, behind the lenses 132 that have a separate function from the strobe LEDs 114. In this embodiment, each optical film lens comprises one or more thin plastic films (sheets), such as are available from Luminit, Inc., that perform light shaping and/or light bending functions. Alternately, the lenses could be traditional cylindrical lenses, which stretch the light into long, narrow stripes. Instead of using films to bend the light, light-curtain LEDs 136 could alternately be mounted to point in the desired direction. These films and/or lenses act to make the light from light-curtain LEDs 136 vertical or almost-vertical planes of light and then to bend them toward the desired target area through which the ball flies. In the example shown in FIG. 1, the lens assembly includes three light curtain lenses 132 positioned in front of three light curtain LEDs 136, and thus creates three separate light curtains, light planes, or light stripes through which the ball can travel, as shown below in FIG. 3.

Optionally, the lens system also contains one or more light-collecting lenses 134, such as Fresnel lenses, positioned in front of the photodetectors, that concentrate the light that is reflected back and onto the photodetector(s). Optionally, the lens assembly may contain one or more light-collecting reflectors, such as parabolic reflectors, to concentrate the received light onto one or more photodetectors.

The processor 140 is in communication with the light-curtain LEDs 136, strobe LEDs 114, photodetectors 116, and camera 120. The processor 140 includes for example an algorithm to compute an approximate speed and position of the ball as it passes by the device, based on the detected signals from the IR light reflected off of the ball and back to the photodetectors. The processor 140 also includes an algorithm to determine the desired strobe duration, strobe timing, and camera exposure time based on the ball's position and speed, in order to capture two (or more) images of the ball in a single exposure. The time between the strobe flashes needs to be long enough so that the two ball images within the double exposure don't overlap, but the time also has to be short enough so that the ball is still within the camera's view for both images. The processor 140 also includes camera and strobe control logic and hardware, such that signals can be sent to the camera module to open and close the shutter and take two photos. The first photo may for example contain a double exposure of the ball at two positions in flight, and the second photo may be a background reference photo. This logic also triggers the strobe (flash) hardware to make the two flashes for the double exposure, as well as flashes during the reference photo to try to get the background as similar as possible.

In some embodiments, the processor 140 is also in communication with a tilt sensor 150, which may for example be a multi-axial (2 or 3 axis) accelerometer that measures the pull of gravity along each of its axes, and can thus be used to determine the 3D orientation of the ball spin measurement system 100 with respect to vertical (e.g., with respect to the gravity vector).

In some embodiments, a first processor 140 may be located in the same housing as the strobe assembly 110, camera assembly 120, and light curtain assembly 130, and in wired communication with elements thereof, and a second processor 145 may be external to the housing (e.g., in a mobile device) and in wireless communication (e.g., Bluetooth, WiFi, etc.) with the first processor 145. In some such configurations, control tasks (e.g., control of the strobe assembly 110 and camera assembly 120) may be performed by the first processor, while computation tasks (e.g., calculation of the spin on the ball) may be performed by the second processor 145, although other arrangements may be used instead or in addition without departing from the spirit of the present disclosure.

Before continuing, it should be noted that the examples described above are provided for purposes of illustration, and are not intended to be limiting. Other devices and/or device configurations may be utilized to carry out the operations described herein.

Figure 2:
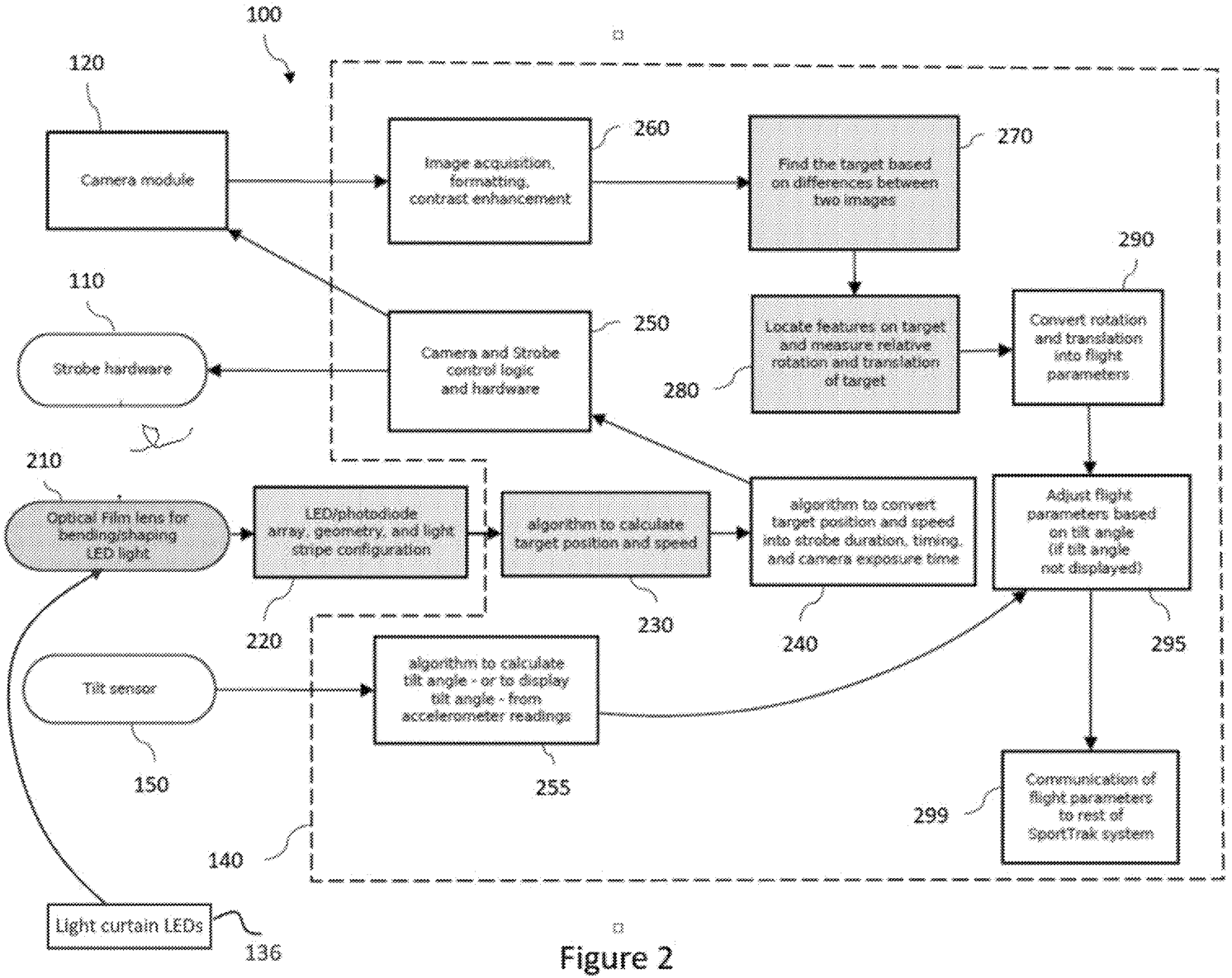
FIG. 2 is a schematic representation, in block diagram form, of at least a portion of an example ball spin measurement system, in accordance with at least one embodiment of the present disclosure.

FIG. 2 is a schematic representation, in block diagram form, of at least a portion of an example ball spin measurement system 100, in accordance with at least one embodiment of the present disclosure. In the example shown in FIG. 2, LED light from light curtain LEDs 136 shines through an optical film lens 210 for bending or shaping the LED light. The arrangement 220 of the LED/photodiode array and the optical film lens then creates a particular configuration of curtains, planes, or stripes of LED light.

In the processor 140, an algorithm 230 calculates the position and speed of the target (e.g., the golf ball) as it passes through the light curtains, and another algorithm 240 uses the target position and speed to compute a strobe duration, strobe timing (e.g., start time of the first and second flash), and camera exposure time in order to capture the double-exposed image of the ball in motion (e.g., in flight). Thus information is then passed to the camera and strobe control logic/hardware 250, which controls the strobe hardware 110 and the camera module 120. In the processor 140, an image acquisition, formatting, and contrast enhancement module 260 then takes the double-exposed target image and the target-free reference image and passes them to an algorithm 270 to find the subimages (e.g., portions of the double-exposed image) containing the target (e.g., the golf ball) based on the differences between the two images (e.g., using a circle-finding algorithm on a subtraction image of the two images). There is also optional code that increases the contrast of the images, useful if the illumination level is relatively low.

Another algorithm 280 then locates features (e.g., marks) on the target and uses them to measure the relative rotation and translation of the target between the first exposure and the second exposure. This software looks for high-contrast spots on the ball and notes their location, then rotates and translates the set of spots (not the images themselves, since that would be more computationally intensive) to find the best matchup of the spots between the two ball subimages.

Another algorithm 290 then converts the rotation and translation into flight parameters such as back spin, side spin, and/or the expected trajectory, distance, and landing point of the ball. Based on the timing of the flash signals and on the characteristics of the camera lens, this block runs thru the mathematical operations described below to figure out how fast the ball is moving and how fast and in what direction it is spinning, based on the relative rotation and translation found above.

Inputs from the tilt sensor 150 are received by an algorithm 255 to calculate the tilt angle of the ball spin measurement system 100 with respect to gravity. In an example, this is the math to convert the pull of gravity into numbers that indicate how far from perfectly level the device is positioned, in degrees.

This information, along with the flight parameters calculated by algorithm 290, is then received by an algorithm 295, which adjusts the flight parameters based on the tilt angle. The flight parameters are calculated above assuming the camera is level. In this module, the flight parameters are adjusted based on the actual tilt of the camera. It is noted that other methods exist for ensuring the flight parameters are based on tilt, and fall within the scope of the present disclosure. An alternative to this and the previous block that may be implemented instead, is a tilt indicator that acts somewhat like an electronic bubble level, and which assists the user in leveling the unit.

The adjusted flight parameters are then passed to a communications module 299 that communicates them to the user (e.g., a golfer) and/or to other components of a sports performance tracking system It is noted that block diagrams are provided herein for exemplary purposes; a person of ordinary skill in the art will recognize myriad variations that nonetheless fall within the scope of the present disclosure. For example, block diagrams may show a particular arrangement of components, modules, services, steps, processes, or layers, resulting in a particular flow of light, energy, data, etc. It is understood that some embodiments of the systems disclosed herein may include additional components, that some components shown may be absent from some embodiments, and that the arrangement of components may be different than shown, resulting in different data flows while still performing the methods described herein.

Figure 3:
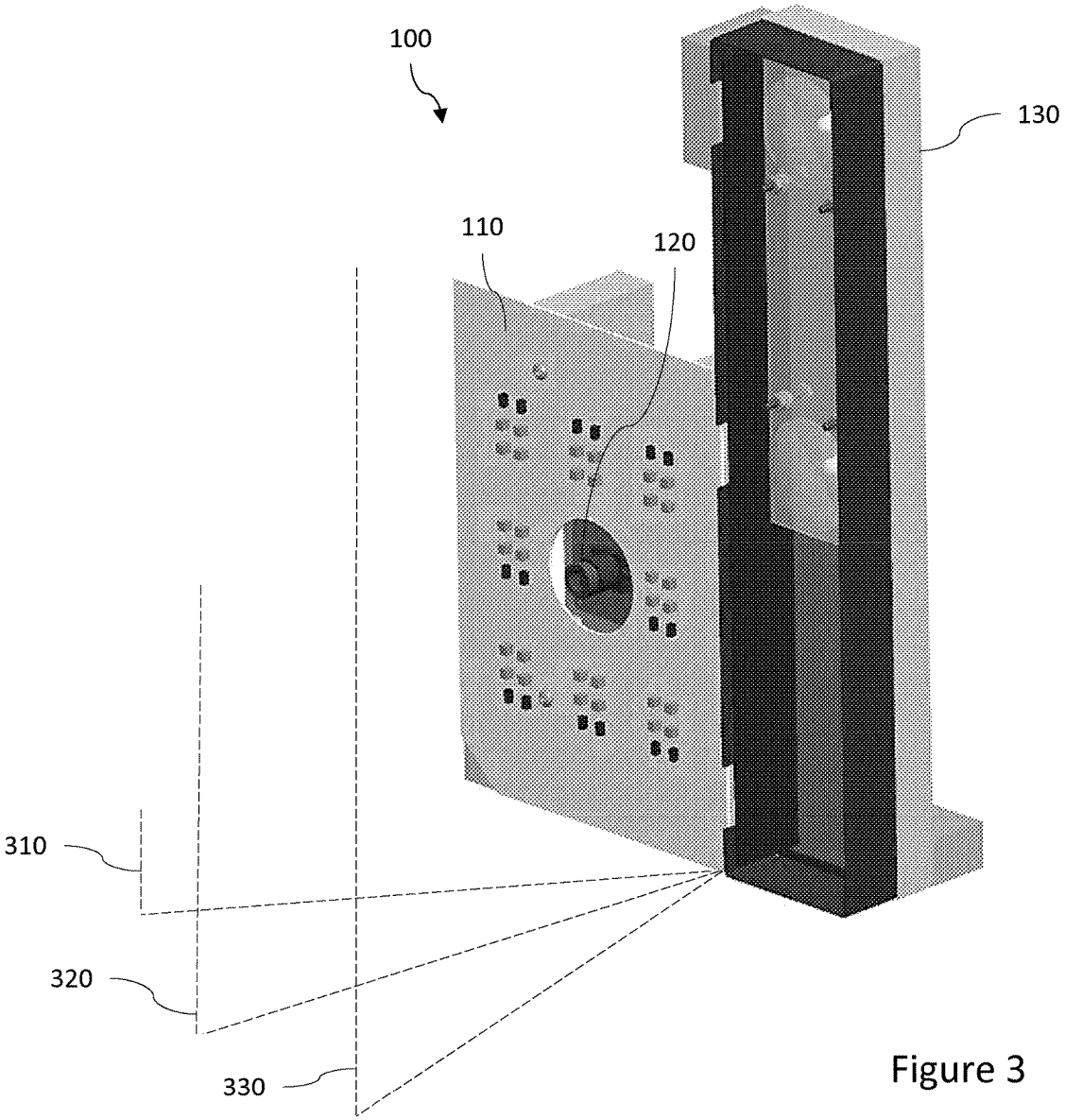
FIG. 3 is a front side perspective view of an exemplary ball spin measurement system, in accordance with at least one embodiment of the present disclosure.

FIG. 3 is a front side perspective view of an exemplary ball spin measurement system 100, in accordance with at least one embodiment of the present disclosure. Visible are the strobe assembly 110, camera assembly 120, and light curtain assembly 130, along with a first LED light curtain 310, second LED light curtain 320, and third LED light curtain 330. In some preferred embodiments, the light curtains (310, 320, 330) are in 2 or more angles with vertical. Other embodiments have the three light curtains (310, 320, 330) parallel or even co-incident, but with LEDs from different heights. Depending on the implementation, the system may generate one, two, three, or more light curtains over an area where the ball will fly when hit. Light is reflected from the ball as it passes through the light curtains. This causes one or more reflections from the multiple LEDs to be received by the photodetectors. The intensity profiles of the reflected light pulses, received over multiple paths from multiple LEDs, is used to calculate approximate ball speed and position.

To generate the double-exposure image, the camera shutter is opened. Two light flashes are created based on the calculated ball speed and position, so as to capture a multiple exposure of the ball in two positions within the camera image. The camera shutter is then closed, and this causes the image to be saved in the camera.

The camera shutter is then opened again, after the ball has passed. Equivalent light flashes are created to illuminate the background as much as it was illuminated when the ball was present, and the camera shutter is closed after the same time duration as for the ball image, which saves a second image in the camera.

The tilt sensor, a multi-axial (2 or 3 axis) accelerometer, measures the pull of gravity along each of its axes. The two images (the first containing two views of the ball against the background, and the second containing only the background), along with the tilt sensor output, are then sent to a processor (either via a wired connection to a processor internal to the same housing as the strobe assembly 110, camera assembly 120, and light curtain assembly 130, or via a wired (e.g., USB) or wireless (e.g., Bluetooth) connection to an external processor on a desktop, laptop, notebook, tablet, handheld, or remote server computer).

The images are compared on the processor to determine approximately where the two ball subimages are located. Shape-detection algorithms determine the exact position of the circles of the two ball subimages. The ball speed and angle are calculated by comparing the exact positions of the two ball subimages. Next, feature-detection algorithms (e.g., algorithms of, based on, or similar to those of the ViVo Mouse head tracker software) are used to determine the positions of marks (e.g., the stamp with the brand of the ball) on the two ball subimages. The sets of marks on each ball subimage are rotated (either by rotating the subimages themselves, or, in a preferred embodiment, by rotating only the marks) to various possible rotation angles to obtain the best match of the marks between the two views of the ball. The ball spin is then calculated from the best rotation angles found.

A tilt algorithm calculates tilt angle from the received tilt sensor data and calculates the tilt angle—i.e., how much from perfectly-level the device is positioned, in degrees. The computed flight parameters (ball speed, angle, spin) are adjusted on the basis of the tilt angle, based on a tilt-compensation algorithm. Motion parameters such as the ball speed and angle can then be transmitted from the PC or tablet by USB, Bluetooth, or other, or can be displayed for review by the user (e.g., a golfer or golfing student).

Figure 4:
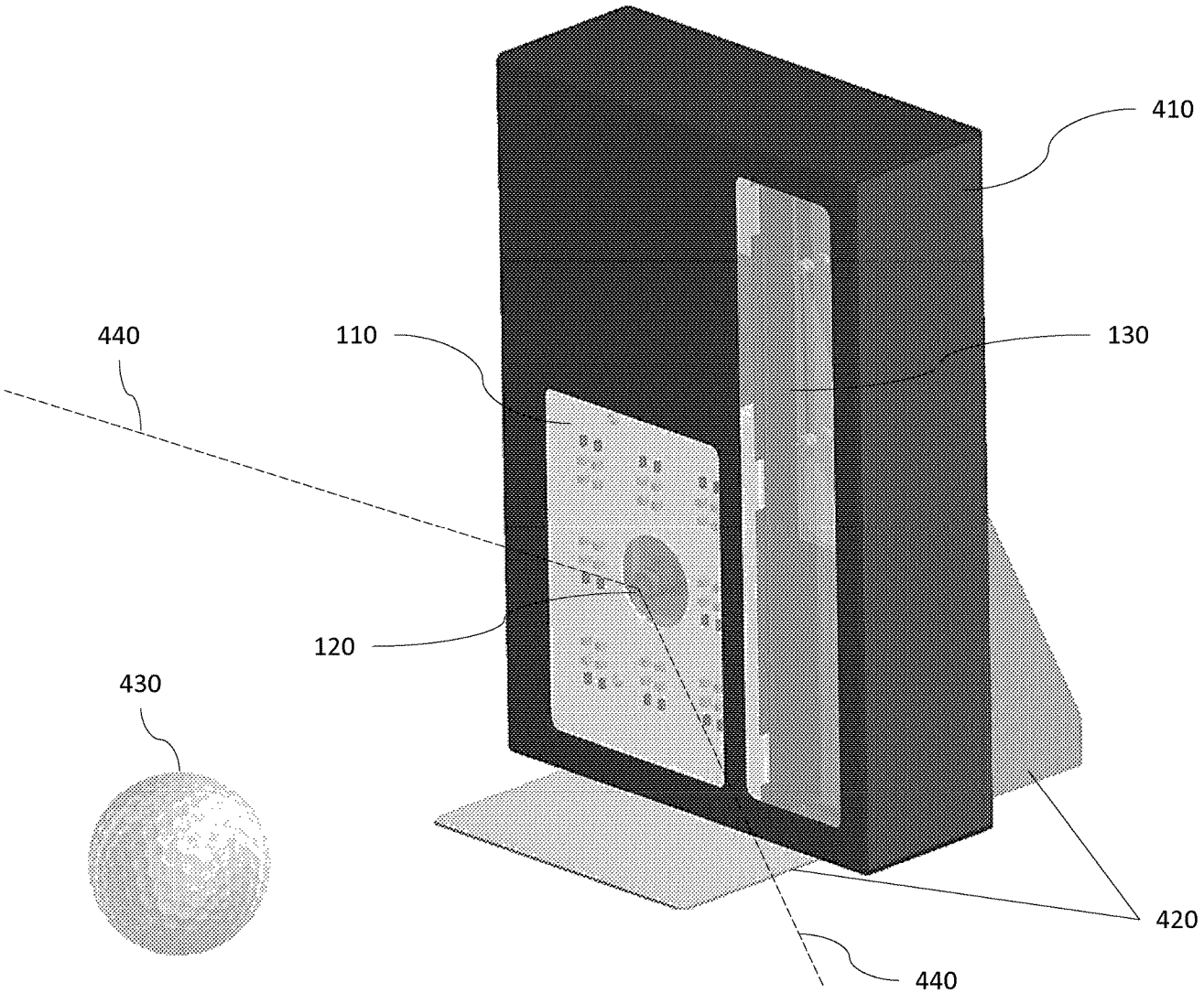
FIG. 4 is a is a front side perspective view of an exemplary ball spin measurement system, in accordance with at least one embodiment of the present disclosure.

FIG. 4 is a front side perspective view of an exemplary ball spin measurement system 100, in accordance with at least one embodiment of the present disclosure. Visible are the strobe assembly 110, camera 120, and light curtain assembly 130, now enclosed by a housing 410 and supported by a stand 420. A target 430 such as a golf ball is within a field of view 440 of the camera 120. Both sub-images of the double-exposed image are captured while the ball 430 is within the camera's field of view 440, whereas the reference image is captured after the ball has left the camera's field of view 440.

Figure 5:
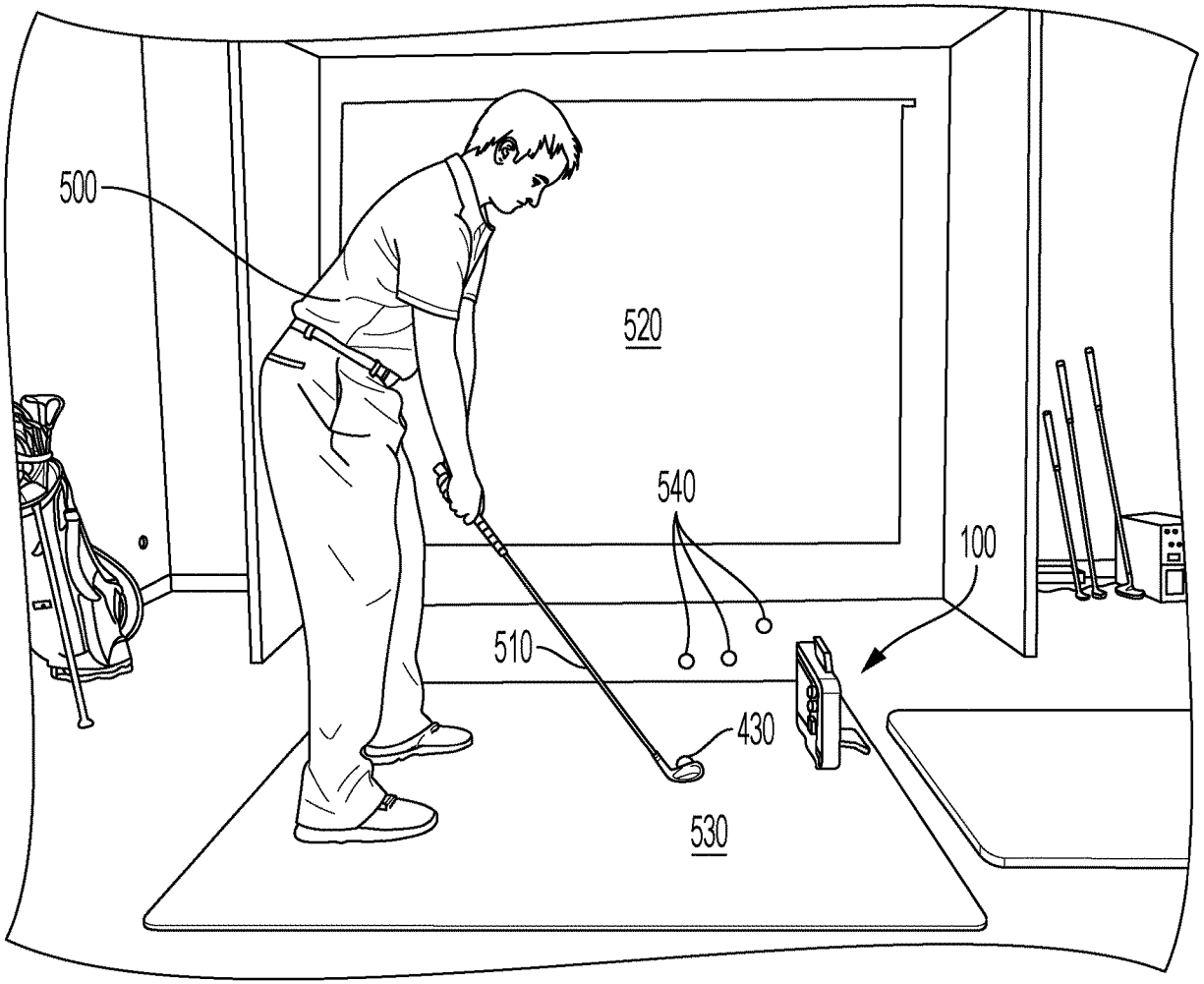
FIG. 5 is a side perspective view of a golfer hitting a golf ball with a golf club, within view of an exemplary ball spin measurement system, in accordance with at least one embodiment of the present disclosure.

FIG. 5 is a side perspective view of a user 500 (e.g., a golfer) hitting a golf ball 430 with a golf club 510, within view of an exemplary ball spin measurement system 100, in accordance with at least one embodiment of the present disclosure. In an example, when struck by the club 510, the ball 430 is propelled toward a catching screen 520, which damps and absorbs the kinetic energy of the ball 430 such that it drops to the floor 520 without rebounding back toward the golfer 500. A number of spent balls 530 can be seen resting on the floor 520 after falling from the catching screen 520.

In some embodiments, the catching screen 520 may be a video display, or a projection screen for a video display. In an example, such a video display may show photographic or computer-generated images of a golf course, and may show the predicted trajectory of the ball 430 as it continues "into" or "behind" the catching screen 520. Since this trajectory is highly dependent on the spin of the ball 430 as well as its velocity vector, the ball spin measurement system 100 provides a clear improvement over the existing art.

In an example, from the point of view of the golfer 500, the ball 430 is placed such that it approximately aligns with the right edge of the ball spin measurement system 100 approximately 12-14 inches away from the unit in the direction of the golfer 500. Depending on the implementation, other arrangements are possible and may be used instead or in addition. It is noted that when struck by a golf club in a normal golf swing, a golf ball may travel at speeds of 0-236 miles per hour (MPH), with spin of 0-11,000 rotations per minute (RPM), or higher. The ball spin measurement system 100 may therefore be capable of performing all of the operations described herein for a ball moving at such velocity and spin.

Figure 6:
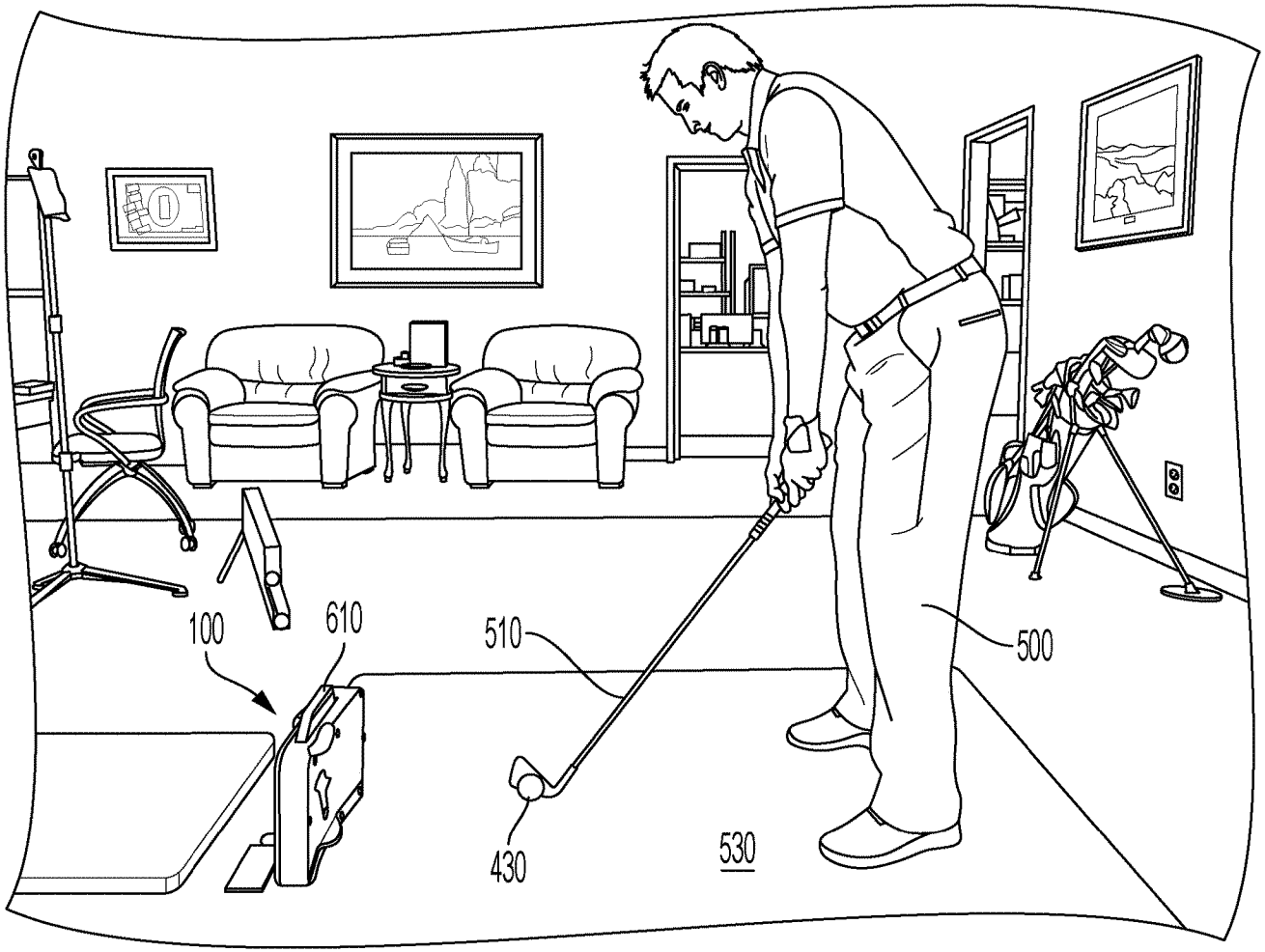
FIG. 6 is a side perspective view of a golfer hitting a golf ball with a golf club, within view of an exemplary ball spin measurement system, in accordance with at least one embodiment of the present disclosure.

FIG. 6 is a side perspective view of a user 500 (e.g., a golfer) hitting a golf ball 430 with a golf club 510, within view of an exemplary ball spin measurement system 100, in accordance with at least one embodiment of the present disclosure. FIG. 6 shows the same arrangement of elements as FIG. 5, but looking away from the catching screen 520 rather than toward it. When the golfer 500 strikes the ball 430 with the club 510, the ball 430 is launched toward the catching screen, and the ball spin measurement system 100 detects the motion, opens the camera shutter, flashes the strobe twice to capture two subimages of the ball 430 while the ball 430 is within the viewing cone of the camera, and then closes the camera shutter and stores the image (which contains the two subimages). After the ball 430 has left the viewing cone, the ball spin measurement system 100 opens the camera shutter again, flashes the strobe twice to duplicate the lighting effects of the previous image, and then closes the shutter and stores the second image as a baseline image that can be subtracted from the first image, to facilitate operation of the circle detection and mark detection algorithms.

As can be seen in FIG. 6, the ball spin measurement system 100 may be compact, lightweight, and cordless (e.g., battery-operated), and may include a handle 610. As such, the ball spin measurement system 100 may be easily portable, transportable, shippable, and/or storable as needed.

Figure 7A:
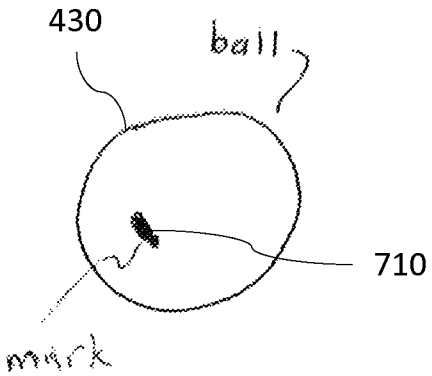
FIG. 7A is a front perspective view of a golf ball that bears a visible mark, in accordance with at least one embodiment of the present disclosure.
Figure 7B:
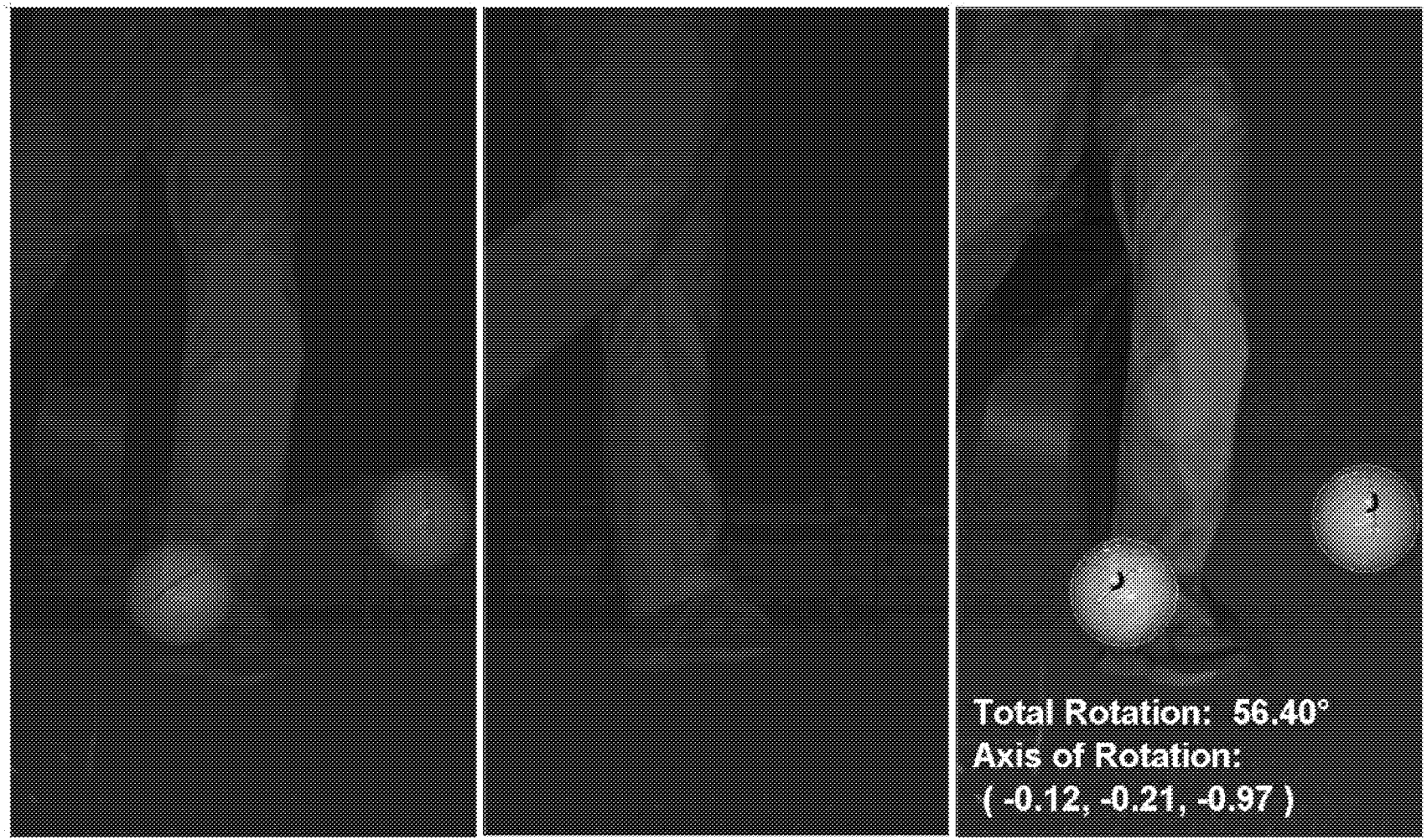
FIG. 7B is a front perspective view of a double-exposed image showing two golf ball sub-images, in accordance with at least one embodiment of the present disclosure.

FIG. 7A is a front perspective view of a golf ball 430 that bears a visible mark 710, in accordance with at least one embodiment of the present disclosure. In a subtraction image (e.g., an image constructed by subtracting the background or baseline image from the double-exposed image of the ball in flight), most regions of the image may be shown as white or black, except those pixels that show a difference between the two images as shown in FIG. 7B. Thus, the stationary background may not appear in the subtraction image. Instead, the subtraction image shows two views of the ball 430 and the club 510 in motion.

In an example, some embodiments of the present disclosure use circle-finding algorithms known in the art of image processing, such as such as the Circle Hough Transform to locate the ball (e.g., two instances of the ball) in the subtraction image, and then use edge-finding algorithms known in the art of image processing, such as Sobel operators, which identify pixel regions where a change in brightness is seen over a region of pixels within the circle identified as the golf ball 430. In such exemplary embodiments, the edges thus found are considered to be the marks 710 on the ball 430. This may result in some marks that appear, to a human, to be a single mark instead being detected as multiple edge areas. However, in most cases this does not impede the proper operation of the ball spin measurement system as described herein. For example, the elongated mark 710 shown here in FIG. 7 may be detected as a series of several smaller marks 710, since the regions of relative darkness may be found over several pixels. If there are multiple mark representations corresponding to what a human would consider one mark 710, these marks can still be aligned according to the algorithms described herein. In the examples that follow, when reference is made to a mark 710, in practice, the algorithm may include multiple closely-located marks 710, within the scope of the methods as described herein. It is also noted that some embodiments may not require a subtraction image, and may thus not require a baseline or background image. Such embodiments fall explicitly within the scope of the present disclosure.

Figure 8:
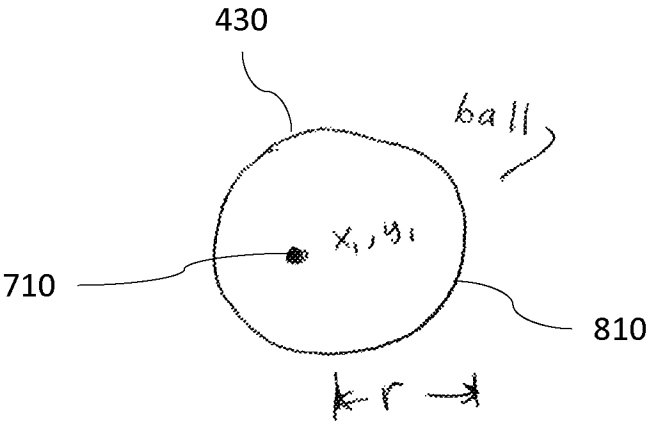
FIG. 8 is a front perspective view of a golf ball that bears a visible mark, in accordance with at least one embodiment of the present disclosure.

FIG. 8 is a front perspective view of a golf ball 430 that bears a visible mark 710, in accordance with at least one embodiment of the present disclosure. Once the ball 430 and its marks 710 have been identified in an image, the ball spin measurement system finds 3D coordinates of each mark, based on its 2D position within the ball circle. Since the outline 810 of the circle is known, it may be assumed that the radius r of a 3D representation of the ball 430 has approximately the same radius r as the circular outline 810 of the ball 430. Then, by assuming the ball 430 (though possibly reversibly deformed by the impact of the golf club) is approximately spherical, the ball spin measurement system can use geometrical relations are used to identify a 3D position of any arbitrary location on the sphere, and thus calculate the 3D positions of each mark 710 that project to the known 2D locations of the mark 710 within the circle 810 on the 2D ball image.

For example, assuming an orthonormal projection, the point shown on the mark at $X_1$, $Y_1$ is found to have a Z value of $Z_1$, based on the sphere equation $$X^2+Y^2+Z^2=r^2 \quad \text{(EQN. 1)}$$

where r is the radius of the sphere.

Once the 3D positions of all marks 710 are found, the next step is to find the rotation in 3D that causes the marks extracted from one ball image to line up with the marks extracted from the other ball image(s). In an example, some embodiments of the present disclosure use a generate-and-test technique to find the best such alignment of the spots. An exemplary algorithm is as described below.

Figure 9:
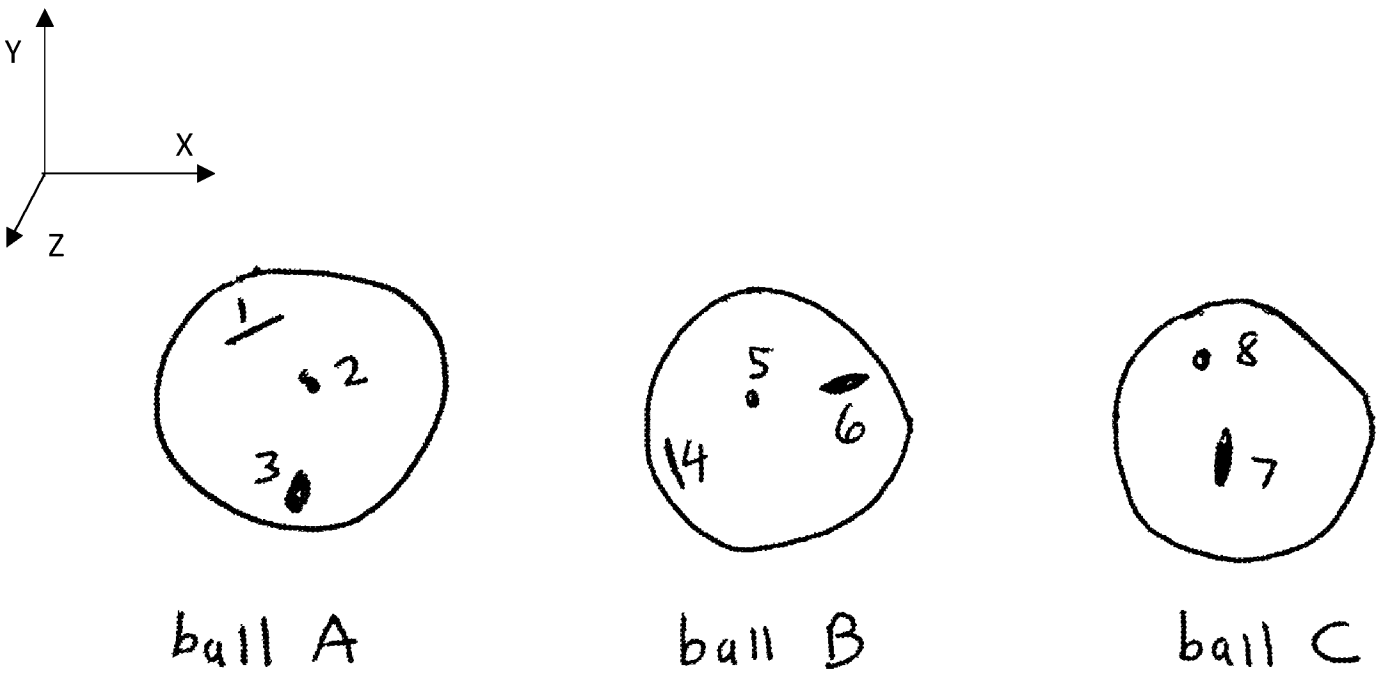
FIG. 9 is a front perspective view of a golf ball 430 in three different rotation states A, B, and C, in accordance with at least one embodiment of the present disclosure.

FIG. 9 is a front perspective view (e.g., an orthonormal projection) of a golf ball 430 in three different rotation states A, B, and C, in accordance with at least one embodiment of the present disclosure. The spin determination algorithm may be applied to two ball images ball A and ball B. The algorithm could be extended to combine comparisons of additional ball images (e.g., ball C), as will be apparent to those of skill in the art: For a selection from every possible three-dimension rotation involving the x, y, and z axes (for example, in one-degree increments): For each mark i detected from the first ball image, for example marks 1, 2, and 3 from ball A in FIG. 9:

Apply the rotation to the mark's coordinates $X_i$, $Y_i$, $Z_i$, to generate a rotated $X_i'$, $Y_i'$, $Z_i'$ position for the mark.

For each mark j extracted from one of the other ball images, for example, marks 4, 5, and 6 on ball B, compare the match of $X_i'$, $Y_i'$, $Z_i'$ to the position $X_j$, $Y_j$, $Z_j$. For example, compare the coordinates of mark 1 to marks 4, 5, and 6 using, for example, the Cartesian distance between the marks. Record the value of the best match from among all marks j.

Combine, for example by a summation, the best values of the matches found for all the marks i.

Choose the three-dimensional rotation that gives the best combination of matches over all the marks. For example, in FIG. 9, a rotation that is mainly about the z axis (e.g., coming out toward the viewer) will give the best mark matchup, and will have mark 1 close to mark 4, mark 2 close to mark 5, and mark 3 close to mark 6.

Optionally, reduce the step-size in the selection of possible angles, and repeat steps 1 and 2 over a smaller range near the best solution found in step 2. This step can be iterated over smaller and smaller angular resolutions.

Sometimes, a mark may be visible on one image but not on another. For example, if the algorithm is applied to balls A and C in FIG. 4, there will not be a rotation providing a good match for all three marks 1, 2, and 3. However, in an example, the best rotation may be the rotation that results in mark 2 close to mark 8, and mark 3 close to mark 7.

In an alternate embodiment, the Z values can be omitted in the position matching step to slightly reduce computational complexity.

Next, the rotation of the ball is converted into spin values. The result of the previous step is a set of rotation angles about one or more axes that describe the rotation of the ball between the multiple ball images. The step involves converting that rotation description into a description of the ball rotation in terms of golfing parameters such as back spin and side spin, or other equivalent representations.

Various algorithms exist in the art for converting such rotations, such as Euler angle rotations, into a spin axis. The preferred embodiment utilizes one of these algorithms to obtain a 3D rotation axis, along with an angle of rotation about that axis, to represent the rotational differences between the first and last image of the ball.

Using sines and cosines, the spin axis and its angle are converted into an equivalent pair of rotations about the horizontal Z axis and vertical Y axis, where the horizontal Z axis rotation corresponds to backspin and the vertical Y axis rotation corresponds to sidespin. (The rotation about the horizontal X axis is typically small and has little effect on ball flight, so may not be used in a preferred embodiment. However, it may be used in other embodiments where an exact description of all ball rotations is desired.)

Converting these rotations, in units such as radians or degrees, into spin values involves knowing the timing between the ball images. One simple equation is:

$$\text{ball spin}=\text{ball rotation}/\text{time between ball images.} \quad \text{(EQN 2)}$$

For example, if the backspin rotation from the above calculations is 20 degrees between two ball images, and the time difference between the two ball images is 1.0 ms, then the backspin is 20/0.001=20,000 degrees per second, or equivalently, 3,333 revolutions per minute) (RPM).

Figure 10:
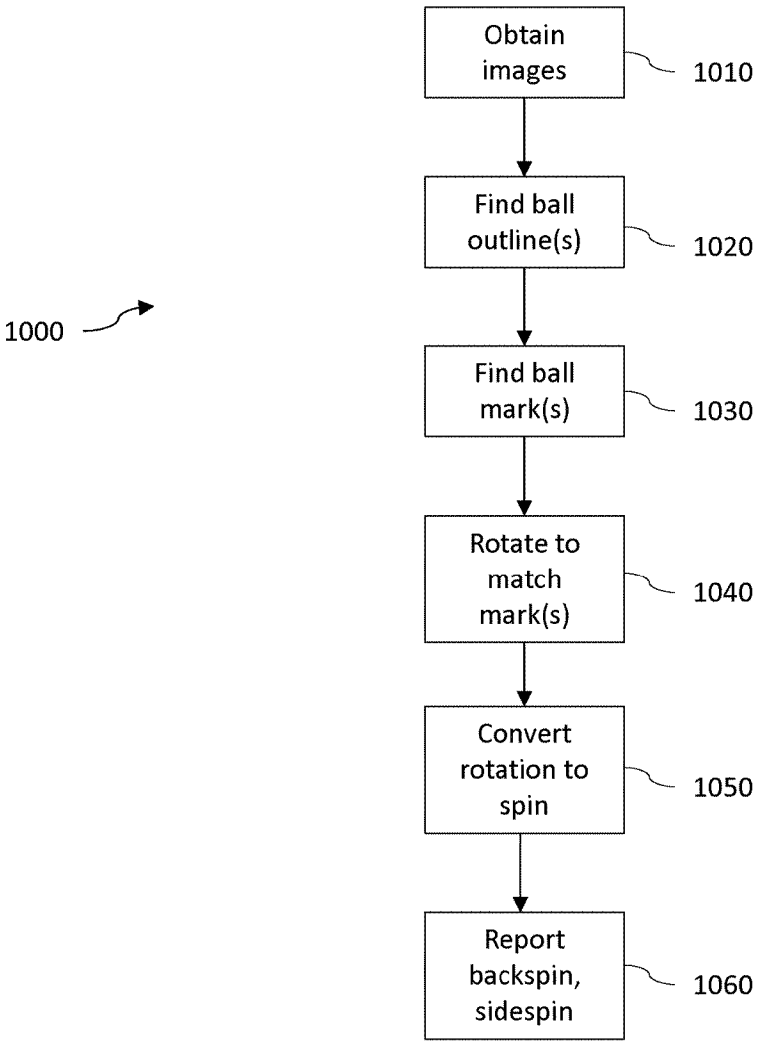
FIG. 10 is a schematic, diagrammatic representation, in flow diagram form, of an example ball spin measurement method, in accordance with at least one embodiment of the present disclosure.

FIG. 10 is a schematic, diagrammatic representation, in flow diagram form, of an example ball spin measurement method 1000, in accordance with at least one embodiment of the present disclosure. It is understood that the steps of method 1000 may be performed in a different order than shown in FIG. 10, additional steps can be provided before, during, and after the steps, and/or some of the steps described can be replaced or eliminated in other embodiments. One or more of steps of the method 1000 can be carried by one or more devices and/or systems described herein, such as components of the ball spin measurement system 100, processor 140, processor 145, and/or processor circuit 1050.

In step 1010, the method 1000 includes obtaining images (e.g., two images) of the ball in motion (e.g., in flight), as described above. Execution then proceeds to step 1020.

In step 1020, the method 1000 includes finding the outlines of the ball in the images, e.g., with a circle finding algorithm as described above. Execution then proceeds to step 1030.

In step 1030, the method 1000 includes finding one or more marks on each image of the ball, and translating them into 3D coordinates. Execution then proceeds to step 1040.

In step 1040, the method 1000 includes rotating the marks in a first image until a closest match is achieved for the marks in a second image, as described above. Execution then proceeds to step 1050.

In step 1050, the method 1000 includes converting this rotation into a spin vector (e.g., a spin axis in X, Y, Z coordinates, and a rate of rotation (e.g., in degrees per second or rotations per minute). Execution then proceeds to step 1060.

In step 1060, the method 1000 includes translating the spin vector into a backspin value and a sidespin value, and reporting these values to the user or to another algorithm. The method is now complete.

It is noted that flow diagrams are provided herein for exemplary purposes; a person of ordinary skill in the art will recognize myriad variations that nonetheless fall within the scope of the present disclosure. For example, the logic of flow diagrams may be shown as sequential. However, similar logic could be parallel, massively parallel, object oriented, real-time, event-driven, cellular automaton, or otherwise, while accomplishing the same or similar functions. In order to perform the methods described herein, a processor may divide each of the steps described herein into a plurality of machine instructions, and may execute these instructions at the rate of several hundred, several thousand, several million, or several billion per second, in a single processor or across a plurality of processors. Such rapid execution may be necessary in order to execute the method in real time or near-real time as described herein. For example, in order to detect that a ball has been struck and is now in motion (e.g., in flight), and then to take a double-exposed image containing two images of the ball while it remains within view of the camera, and then to take a subsequent reference photo under the same strobe condition when the ball is no longer visible, the ball spin measurement system may need to perform some or all of the steps described herein in a span of less than 1 millisecond for a 200 mph ball and 3 inches of travel. This of course depends on the distance the ball travels from the light curtain to the image-taking area.

Figure 11:
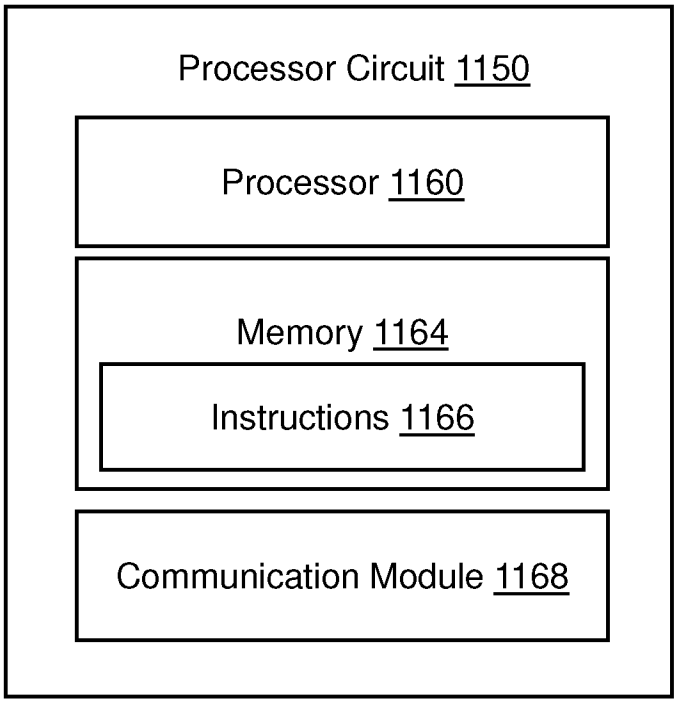
FIG. 11 is a schematic diagram of a processor circuit, in accordance with at least one embodiment of the present disclosure.

FIG. 11 is a schematic diagram of a processor circuit 1150, in accordance with at least one embodiment of the present disclosure. The processor circuit 1150 may be implemented in the system 100, or other devices or workstations (e.g., third-party workstations, network routers, etc.), or on a cloud processor or other remote processing unit, as necessary to implement the method. As shown, the processor circuit 1150 may include a processor 1160, a memory 1164, and a communication module 1168. These elements may be in direct or indirect communication with each other, for example via one or more buses.

The processor 1160 may include a central processing unit (CPU), a digital signal processor (DSP), an ASIC, a controller, or any combination of general-purpose computing devices, reduced instruction set computing (RISC) devices, application-specific integrated circuits (ASICs), field programmable gate arrays (FPGAs), or other related logic devices, including mechanical and quantum computers. The processor 1160 may also comprise another hardware device, a firmware device, or any combination thereof configured to perform the operations described herein. The processor 1160 may also be implemented as a combination of computing devices, e.g., a combination of a DSP and a microprocessor, a plurality of microprocessors, one or more microprocessors in conjunction with a DSP core, or any other such configuration.

The memory 1164 may include a cache memory (e.g., a cache memory of the processor 1160), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, other forms of volatile and non-volatile memory, or a combination of different types of memory. In an embodiment, the memory 1164 includes a non-transitory computer-readable medium. The memory 1164 may store instructions 1166. The instructions 1166 may include instructions that, when executed by the processor 1160, cause the processor 1160 to perform the operations described herein. Instructions 1166 may also be referred to as code. The terms "instructions" and "code" should be interpreted broadly to include any type of computer-readable statement(s). For example, the terms "instructions" and "code" may refer to one or more programs, routines, subroutines, functions, procedures, etc. "Instructions" and "code" may include a single computer-readable statement or many computer-readable statements.

The communication module 1168 can include any electronic circuitry and/or logic circuitry to facilitate direct or indirect communication of data between the processor circuit 1150, and other processors or devices. In that regard, the communication module 1168 can be an input/output (I/O) device. In some instances, the communication module 1168 facilitates direct or indirect communication between various elements of the processor circuit 1150 and/or the system 100. The communication module 1168 may communicate within the processor circuit 1150 through numerous methods or protocols. Serial communication protocols may include but are not limited to United States Serial Protocol Interface (US SPI), Inter-Integrated Circuit ($I^2C$), Recommended Standard 232 (RS-232), RS-485, Controller Area Network (CAN), Ethernet, Acronautical Radio, Incorporated 429 (ARINC 429), MODBUS, Military Standard 1553 (MIL-STD-1553), or any other suitable method or protocol. Parallel protocols include but are not limited to Industry Standard Architecture (ISA), Advanced Technology Attachment (ATA), Small Computer System Interface (SCSI), Peripheral Component Interconnect (PCI), Institute of Electrical and Electronics Engineers 488 (IEEE-488), IEEE-1284, and other suitable protocols. Where appropriate, serial and parallel communications may be bridged by a Universal Asynchronous Receiver Transmitter (UART), Universal Synchronous Receiver Transmitter (USART), or other appropriate subsystem.

External communication (including but not limited to software updates, firmware updates, preset sharing between the processor and central server, calculation results, or readings from the photodetectors or camera) may be accomplished using any suitable wireless or wired communication technology, such as a cable interface such as a universal serial bus (USB), micro USB, Lightning, or FireWire interface, Bluetooth, Wi-Fi, ZigBee, Li-Fi, or cellular data connections such as 2G/GSM (global system for mobiles), 3G/UMTS (universal mobile telecommunications system), 4G, long term evolution (LTE), WiMax, or 5G. For example, a Bluetooth Low Energy (BLE) radio can be used to establish connectivity with a cloud service, for transmission of data, and for receipt of software patches. The controller may be configured to communicate with a remote server, or a local device such as a laptop, tablet, or handheld device, or may include a display capable of showing status variables and other information. Information may also be transferred on physical media such as a USB flash drive or memory stick.

As will be readily appreciated by those having ordinary skill in the art after becoming familiar with the teachings herein, the ball spin measurement system detects that a golf ball is in motion, and, based on the speed and direction of the golf ball, determines an exposure time and strobe timing to capture two images or sub-images of the ball in flight. Based on the motion of marks detected on the surface of the ball between the two images, the ball spin measurement system determines a rotation vector between the two images, and converts this into a rotation speed, which is then used to determine golf-specific parameters such as backspin and sidespin. Accordingly, it can be seen that the ball spin measurement system fills a long-standing need in the art, by providing a small, lightweight, portable, transportable, shippable, and/or storable device that is capable of determining, in real time, the position, speed, direction of motion (e.g., a velocity vector), and direction and magnitude of rotation (e.g., backspin and sidespin) of a golf ball struck by a golf club. This information can then be used to predict the trajectory of the golf ball and/or to provide guidance to the golfer to improve their swing and/or club choice.

A number of variations are possible on the examples and embodiments described above. For example, the system may employ a motion sensor or proximity sensor to determine when the user's golf swing has begun, or may use image recognition or motion detection from captured camera images to achieve the same determination. The system may use one or more 3D cameras instead of or in addition to the one or more 2D cameras described herein. The images may be captured in black and white, color, false color, enhanced color, etc., whether in visible light, ultraviolet light, infrared light, or combinations thereof. The system may be larger or smaller than described herein, and may be configured to determine the spin of larger or smaller target objects that are moving and/or spinning faster or slower than described herein, without departing from the spirit of the present disclosure.

The technology described herein may be applied not only to golf, but to any situation where the spin of a sphere is important to its trajectory. Examples include sports such as tennis, racquetball, pickleball, baseball, softball, and cricket, as well as non-sporting activities.

Accordingly, the logical operations making up the embodiments of the technology described herein are referred to variously as operations, steps, objects, elements, components, or modules. Furthermore, it should be understood that these may occur, or be arranged or performed, in any order, unless explicitly claimed otherwise or a specific order is inherently necessitated by the claim language.

All directional references e.g., upper, lower, inner, outer, upward, downward, left, right, lateral, front, back, top, bottom, above, below, vertical, horizontal, clockwise, counterclockwise, proximal, and distal are only used for identification purposes to aid the reader's understanding of the claimed subject matter, and do not create limitations, particularly as to the position, orientation, or use of the ball spin measurement system. Connection references, e.g., attached, coupled, connected, joined, or "in communication with" are to be construed broadly and may include intermediate members between a collection of elements and relative movement between elements unless otherwise indicated. As such, connection references do not necessarily imply that two elements are directly connected and in fixed relation to each other. The term "or" shall be interpreted to mean "and/or" rather than "exclusive or." The word "comprising" does not exclude other elements or steps, and the indefinite article "a" or "an" does not exclude a plurality. Unless otherwise noted in the claims, stated values shall be interpreted as illustrative only and shall not be taken to be limiting.

The above specification, examples and data provide a complete description of the structure and use of exemplary embodiments of the ball spin measurement system as defined in the claims. Although various embodiments of the claimed subject matter have been described above with a certain degree of particularity, or with reference to one or more individual embodiments, those skilled in the art could make numerous alterations to the disclosed embodiments without departing from the spirit or scope of the claimed subject matter.

Still other embodiments are contemplated. It is intended that all matter contained in the above description and shown in the accompanying drawings shall be interpreted as illustrative only of particular embodiments and not limiting. Changes in detail or structure may be made without departing from the basic elements of the subject matter as defined in the following claims.

What is claimed is:

1. A method of measuring spin of a golf ball comprising:
obtaining at least two images of the golf ball after a golf club contacts the golf ball;
identifying a time span between the obtained at least two images to create a numerical time difference;
defining an outline of the golf ball while the golf ball is in flight;
finding at least one marking on the golf ball in each golf ball image;
finding rotations of the golf ball by aligning the at least one marking on the golf ball in each golf ball image;
converting the rotations of the golf ball into spin values by combining the rotations and the numerical time differences, wherein the spin values comprise at least a spin axis and a rotation angle; and
displaying the spin values to a user,
wherein the at least two images of the golf ball are taken by a single camera in quick succession and stored in quick succession,
wherein the camera further comprises a long shutter that stays open for an extended period of time,
wherein the camera further comprises at least two strobe flashes, wherein the at least two strobe flashes create a double exposure effect with the at least two images of the golf ball superimposed in one overall image taken by the camera.

2. The method of claim 1, wherein the spin axes and the angles are converted into an equivalent pair of rotations about a horizontal Z axis and vertical Y axis, wherein the horizontal Z axis rotation corresponds to backspin and the vertical Y axis rotation corresponds to sidespin.

3. The method of claim 2, wherein the spin axes and the angles are converted into a rotation about the horizontal X axis, which corresponds to backspin.

4. The method of claim 1, wherein the camera is housed in a launch-monitor positioned approximate to a golfer hitting golf balls.

5. The method of claim 4, wherein the launch monitor displays the spin values to be viewed by the golfer.

6. The method of claim 1, wherein the at least two images of the golf ball are taken by two cameras in quick succession and stored in quick succession.

7. The method of claim 1, the outline of the golf ball is a circle, and wherein X, Y and Z coordinates of the at least one mark on the golf ball are determined from a known 2D location of the at least one mark within the circle.

8. The method of claim 7, wherein the X, Y, and Z coordinates are determined in an orthonormal projection.

9. A system, comprising:
a memory;
a display; and
one or more processors operatively coupled to the memory, the processors being configured to execute operations that, when executed, cause the processors to perform operations, the operations, comprising:
obtaining at least two images of a golf ball after a golf club contacts the golf ball captured by a camera positioned proximate to a golfer;
identifying a time span between the obtained at least two images to create a numerical time difference;
defining an outline of the golf ball while the golf ball is in flight;

finding at least one marking on the golf ball in each golf ball image;

finding rotations of the golf ball by aligning the at least one marking on the golf ball in each golf ball image; and converting the rotations of the golf ball into spin values by combining the rotations and the numerical time differences, wherein the spin values comprise at least a spin axis and a rotation angle, wherein the at least two images of the golf ball are taken by the camera in quick succession and stored in quick succession, wherein the camera further comprises a long shutter that stays open for an extended period of time, wherein the camera further comprises at least two strobe flashes, wherein the at least two strobe flashes create a double exposure effect with the at least two images of the golf ball superimposed in one overall image taken by the camera.

10. The system of claim 9, wherein the spin axes and the angles are converted into an equivalent pair of rotations about the horizontal z axis and vertical y axis, wherein the horizontal z axis rotation corresponds to backspin and the vertical y axis rotation corresponds to sidespin.

11. The system of claim 9, wherein the camera, memory and one or more processors are housed in a launch-monitor positioned proximate to a golfer hitting golf balls.

12. The system of claim 9, wherein the display shows the spin values to be viewed by the golfer.

13. The system of claim 9, further comprising a second camera that obtains additional images of the golf ball taken in quick succession and stored in quick succession.

14. A non-transitory computer-readable storage medium having encoded therein programming code executable by a processor to perform operations, the operations comprising:

obtaining at least two images of a golf ball after a golf club contacts the golf ball;

identifying a time span between the obtained at least two images to create a numerical time difference;

defining an outline of the golf ball while the golf ball is in flight;

finding at least one marking on the golf ball in each golf ball image;

finding rotations of the golf ball by aligning the at least one marking on the golf ball in each golf ball image; and converting the rotations of the golf ball into spin values by combining the rotations and the numerical time differences, wherein the spin values comprise at least a spin axis and a rotation angle, wherein the at least two images of the golf ball are taken by the camera in quick succession and stored in quick succession, wherein the camera further comprises a long shutter that stays open for an extended period of time, wherein the camera further comprises at least two strobe flashes, wherein the at least two strobe flashes create a double exposure effect with the at least two images of the golf ball superimposed in one overall image taken by the camera.

* * * * *